United States Patent [19]

O'Neill

[11] 4,421,956

[45] Dec. 20, 1983

[54] LOUD SPEAKER WITH MINIMIZED MAGNETIC LEAKAGE

[75] Inventor: Robert M. O'Neill, Meridian, Miss.

[73] Assignee: Peavey Electronics Corp., Meridian, Miss.

[21] Appl. No.: 306,926

[22] Filed: Sep. 29, 1981

[51] Int. Cl.[3] ..... H04R 9/00; H04R 9/06

[52] U.S. Cl. ..... 179/120; 179/115.5 R; 179/117; 179/119 R

[58] Field of Search ..... 179/115.5 R, 117, 119, 179/120

[56] References Cited

U.S. PATENT DOCUMENTS 3,296,386 1/1967 Fansfelow .
3,358,089 12/1967 Parker .
3,453,400 7/1969 Coen .
3,881,074 4/1975 Kawamura .
3,953,687 4/1976 Carbonneau .

FOREIGN PATENT DOCUMENTS 1290148 12/1960 France ..... 179/115.5 R
1022850 3/1966 United Kingdom .
1229040 4/1971 United Kingdom .
1515677 6/1978 United Kingdom .
1568026 5/1980 United Kingdom .

*Primary Examiner*—G. Z. Rubinson
*Assistant Examiner*—Danita R. Byrd
*Attorney, Agent, or Firm*—Berman, Aisenberg & Platt

[57] ABSTRACT

A loudspeaker is provided which has a novel integrally formed back plate and pole-piece. The back plate and pole-piece has an annular portion and a toroidal portion. The result is a marked reduction in magnetic leakage caused by reluctance due to interfaces and corners.

4 Claims, 2 Drawing Figures

LOUD SPEAKER WITH MINIMIZED MAGNETIC LEAKAGE

TECHNICAL FIELD

This invention is an improved loudspeaker for converting electrical energy to acoustical energy.

BACKGROUND ART

Loudspeakers are generally known in the art. A loudspeaker generally comprises a permanent magnet and a voice coil through which an electrical signal is passed. The interaction between the current passing through the voice coil and the magnetic field produced by the permanent magnet causes the voice coil to oscillate in accordance with the electrical signal. It is desirable to have the voice coil move through a small circular gap, the magnetic field being concentrated across the gap. In U.S. Pat. No. 3,358,089 there is shown a loudspeaker where the magnet is cup-shaped and has a cylindrical pole-piece located in the center of the cup, and a disk located on the upper edge of the cup. The shape of the magnet, the pole-piece and the disk serve to direct the magnetic field across a gap between the pole-piece and the disk. U.S. Pat. Nos. 3,296,386; 3,453,400; 3,953,687; and 3,881,074 show loudspeakers where the permanent magnet is a flat, annular element. These loudspeakers have a pole-piece which is generally cylindrical and extends through the central hole of the annular magnet, and a back plate upon which the magnet rests. An annular end plate is placed on the side of the magnet opposite the back plate. The magnetic field is concentrated into the gap between the pole-piece and the annular end plate. In the speaker shown by U.S. Pat. No. 3,953,687, the cylindrical pole-piece is separate from the disk-like back plate and the back plate is tapered to save material. In U.S. Pat. No. 3,453,400 there is shown a loudspeaker with a pole-piece integrally formed with a radially tapered back plate. The thickness of the back plate is taught to be equal to the thickness of the pole-piece.

STATEMENT OF THE INVENTION

A common problem with loudspeakers of the type described is the leakage of the magnetic field due to magnetic reluctance caused by angles and interfaces in the back plate and pole-piece. If the back plate is a separate element from the pole piece the interface between these two elements will be a source of leakage of the magnetic field. Likewise, sharp angles and corners are sources of magnetic leakage.

Focusing of the magnetic field and elimination of the loss of magnetic flux is very important to the efficiency of a loudspeaker. The efficiency of the speaker is given the following mathematical relationship:

$$\% \text{ Eff} = \left[ \frac{\rho_o B^2 L^2 S_d^2}{2\pi c \, Re[\Sigma(\text{moving masses})]^2} \right] 100$$

where $\rho_o$=Density of air
B=Magnetic flux density
L=Length of wire in the gap
$S_d$=Area of diaphragm
C=Speed of sound
Re=Electrical resistance of the voice coil It may be seen from this equation that the efficiency of the speaker is proportional to the square of the magnetic flux density in the gap. Thus increases in the magnetic field flux are quite significant and result in a much more efficient loudspeaker.

In the loudspeaker of the present invention the losses due to leakage of the magnetic field are minimized with the result that the magnetic field at the gap is much greater. This result is accomplished through the use of an inventive back plate and the pole-piece which is shaped to have no interfaces or sharp angles or corners and to efficiently concentrate the magnetic field into the gap. The back plate and pole-piece are integrally formed of a homogeneous material.

This improved geometry for the back plate and pole-piece allows less expensive steel compositions to be used while maintaining the field strength in the voice coil gap. This results in a more economical and yet still high performance speaker.

DETAILED DESCRIPTION OF THE DRAWINGS

Figure 1:
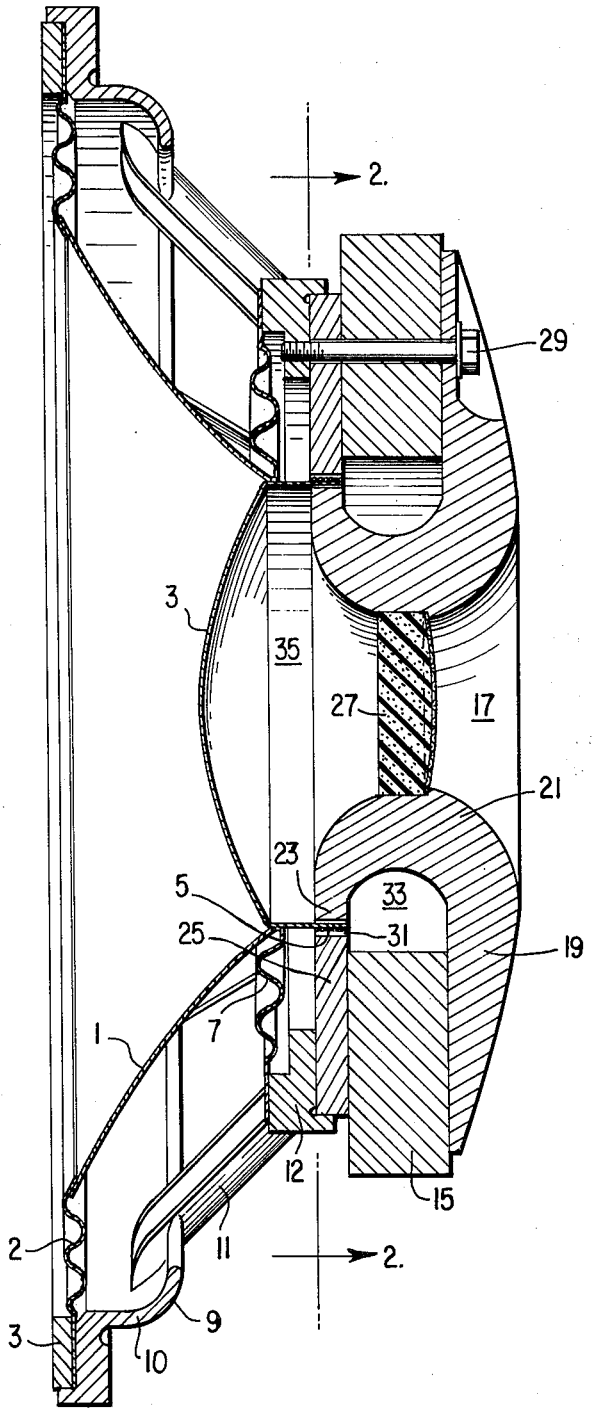
FIG. 1 is a cross section of the improved speaker of the invention.

In FIG. 1 there is shown a cross sectional view of the inventive loudspeaker. A truncated conical diaphragm is illustrated at 1, and is supported on one end by a flexible support 2 and on another end by the spider 7. The flexible support 2 and the spider 7 are secured to the upper and lower portion of the basket respectively by adhesives or other known means. The annular ring 13 acts as a gasket. Attached to the diaphragm is a voice coil including a dome portion 3 and a coil winding 5. The voice coil is attached to the diaphragm by known means. The basket 9 includes an upper annular portion 10 and a lower annular portion 12. The upper and lower annular portions are connected by supports 11. The basket assembly which comprises the basket, the diaphragm, the voice coil dome, the spider and the flexible supports is a self-contained unit which may be easily removed from the remainder of the speaker for repair or replacement.

The magnet assembly of the inventive loudspeaker includes a magnet 15, a front plate 25 and an integral back plate and pole-piece 17. The magnet 15 comprises an annular ceramic magnet. The integral back plate and pole-piece includes an annular and radially tapered portion 19, a generally toroidal portion 21 and an annular portion 23. The portions 19, 21 and 23 are integrally formed together such that there is no interface and such that there are no sharp corners or edges. As explained above, this lack of interfaces and corners greatly reduces the leakage of the magnetic field resulting in a more efficient speaker. The magnet 15 is placed over the pole-pieces 21 and 23 such that it rests upon the annular portion 19. Resting on the magnet is an annular front plate 25. Between the inner edge of the front plate 25 and the outer edge of the annular portion 23 is a gap 31 across which the magnetic field is directed. The voice coil winding 5 is located in the gap 31 such that electrical signals in the voice coil will be converted to physical movements of the voice coil thus producing acoustical energy.

The shape of the integral back plate and pole-piece lies at the heart of the invention. While it is integral, it may be viewed as comprising three portions. The portion 19 is annular and serves to support the magnet in addition to focusing the magnetic field. The element 19 is tapered in the radially outward direction to reduce leakage and to reduce the weight of the back plate. The second part of the back plate and pole-piece is the toroidal portion 21. This portion is convex to the interior part of the speaker and concave to the exterior part of the speaker. There is a space 33 between the inner edge of the magnet 15 and the outer concave edge of the toroidal portion 21. The third portion of the back plate and pole-piece is the annular portion 23 which terminates at a face on one side of the gap 31. The annular portion 23 may have constant thickness in a direction parallel to the axis of the toroid. Thus the magnetic flux from the magnet 15 is focused by the back plate and pole-piece and leakage is minimized because of the absence of interfaces and corners.

The back plate and pole-piece 17 has a central hole in which is placed a dust filter 27. When the voice coil 3 oscillates air is forced into and out of the area 35 bounded by the voice coil dome and the toroidal pole-piece. This movement of air results in cooling the coil dome thus increasing the efficiency of the speaker.

The magnet assembly is secured to the basket by means of a plurality of bolts 29 which extend through the magnet assembly and screw into threads in the lower annular portion of the basket.

Figure 2:
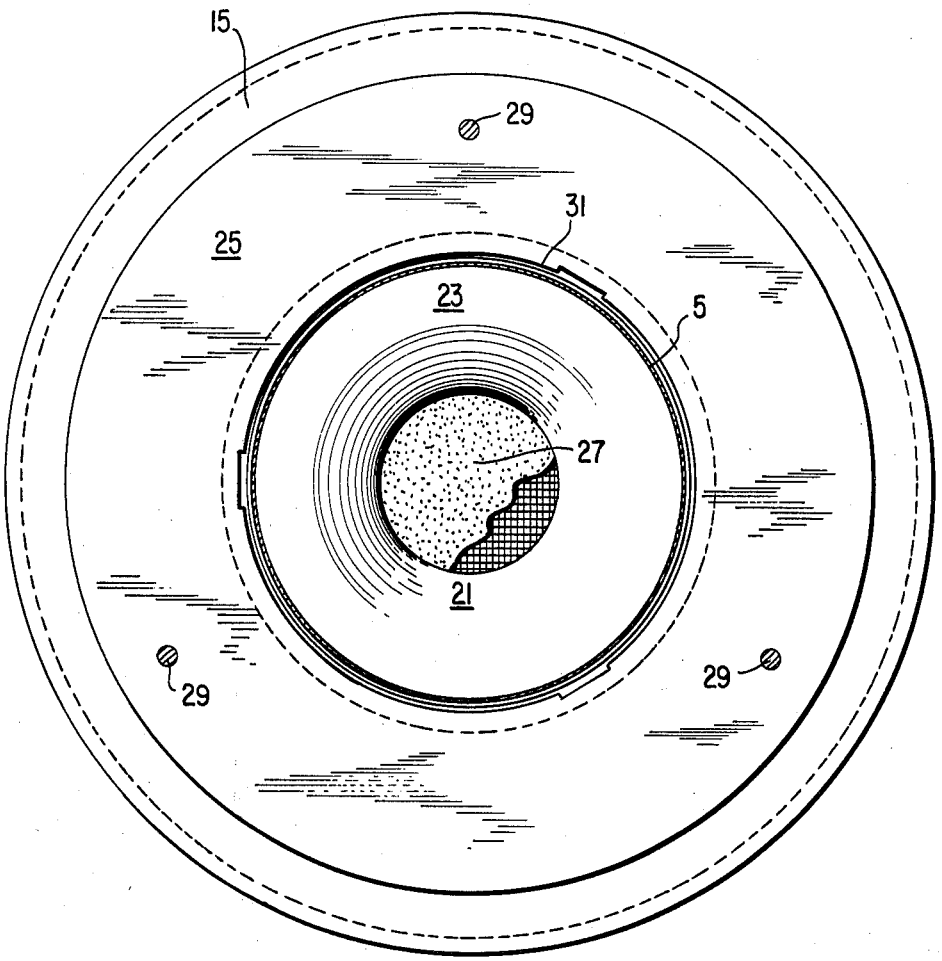
FIG. 2 is a cross sectional view taken along line 2—2 of FIG. 1.

FIG. 2 shows a cross section taken along line 2—2 of FIG. 1. The dust filter 27 comprises a foamlike material and a supporting screen, and in FIG. 2 the foam material is shown as partially cut away.

The back plate and pole-piece curvature and thickness are such that the material always remains below magnetic saturation. Because of the increased focusing ability provided by the above-described shape, the back plate and pole-piece may be forged instead of cast but the invention contemplates forging, molding, casting or sintering. Furthermore, the steel used to make the back plate and pole-piece may have a higher carbon content than in the prior art and still produce a large magnetic field in the gap. This results in a high quality speaker produced at lower cost. A working embodiment of the inventive speaker has a back plate and pole-piece made of 0.1 percent carbon steel and a peak flux density in the gap of 14,500 Gauss.

What is claimed is:

1. In a loudspeaker, which includes a diaphragm, a voice coil attached to the diaphragm, a basket for supporting the diaphragm, an annular permanent magnet, an annular front plate between the magnet and the basket, a back plate on the side of the magnet opposite the front plate, and a pole-piece extending through the annular magnet and forming a magnetic gap with the front plate, the improvement wherein:

said back plate and pole piece are integral, said back plate being annular and having a thickness which smoothly tapers radially from a first inner thickness to a smaller circumferential thickness, said pole piece having a toroidal portion with a first surface convex to a central opening and a second surface concave to the exterior of said pole piece, an upper surface of said back plate merging smoothly with said second surface and a lower surface of said back plate merging smoothly with said first surface, said pole piece including a flat annular portion merging smoothly with the toroidal portion and extending parallel to said upper surface and terminating in a cylindrical surface forming one side of said gap, whereby the magnetic field of said magnet is concentrated into said gap and leakage of the magnetic field is minimized.

2. The loudspeaker of claim 1 wherein said annular portion is of constant thickness.

3. The loudspeaker of claim 1 wherein said back plate and pole piece are of forged steel.

4. Integral back plate and pole-piece for use in an electro-magnetic energy transducer, said back plate being annular and having a thickness which smoothly tapers radially from a first inner thickness to a smaller circumferential thickness, said pole piece having a toroidal portion with a first surface convex to a central opening and a second surface concave to the exterior of said pole piece, an upper surface of said back plate merging smoothly with said second surface and a lower surface of said back plate merging smoothly with said first surface, said pole piece including a flat annular portion merging smoothly with the toroidal portion and extending parallel to said upper surface and terminating in a cylindrical surface.

* * * * *